US011492689B2

(12) United States Patent
Ando et al.

(10) Patent No.: US 11,492,689 B2
(45) Date of Patent: Nov. 8, 2022

(54) RAIL AND METHOD FOR MANUFACTURING SAME

(71) Applicant: JFE STEEL CORPORATION, Tokyo (JP)

(72) Inventors: Keisuke Ando, Tokyo (JP); Tatsumi Kimura, Tokyo (JP); Satoshi Igi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 71 days.

(21) Appl. No.: 17/040,979

(22) PCT Filed: Mar. 28, 2019

(86) PCT No.: PCT/JP2019/013864
§ 371 (c)(1),
(2) Date: Sep. 24, 2020

(87) PCT Pub. No.: WO2019/189686
PCT Pub. Date: Oct. 3, 2019

(65) Prior Publication Data

US 2021/0102277 A1 Apr. 8, 2021

(30) Foreign Application Priority Data

Mar. 30, 2018 (JP) ..... JP2018-068791

(51) Int. Cl.
*C22C 38/34* (2006.01)
*C21D 6/00* (2006.01)
(Continued)

(52) U.S. Cl.
CPC ..... *C22C 38/34* (2013.01); *C21D 6/002* (2013.01); *C21D 6/005* (2013.01); *C21D 6/008* (2013.01);
(Continued)

(58) Field of Classification Search
CPC .. C21D 2211/009; C21D 6/002; C21D 6/005; C21D 6/008; C21D 8/005; C21D 9/04;
(Continued)

(56) References Cited

U.S. PATENT DOCUMENTS 4,375,995 A 3/1983 Sugino et al.
5,658,400 A 8/1997 Uchino et al.
(Continued)

FOREIGN PATENT DOCUMENTS

CN 106435367 A 2/2017
EP 2447383 A1 5/2012
(Continued)

OTHER PUBLICATIONS

NPL: Machine translation of JP-2004223531-A, Aug. 2004 (Year: 2004).*
(Continued)

*Primary Examiner* — Jie Yang
(74) *Attorney, Agent, or Firm* — Kenja IP Law PC

(57) ABSTRACT

The rail having a chemical composition containing C: 0.70-1.00 mass %, Si: 0.50-1.60 mass %, Mn: 0.20-1.00 mass %, P: ≤0.035 mass %, S: ≤0.012 mass %, Cr: 0.40-1.30 mass %, where Ceq defined by the formula (1) is 1.04-1.25, $$Ceq=[\%\ C]+([\%\ Si]/11)+([\%\ Mn]/7)+([\%\ Cr]/5.8) \quad (1)$$

where [% M] is the content in mass % of the element M, the balance being Fe and inevitable impurities, where Ceq(max) is ≤1.40, where the Ceq(max) is determined by the formula (2) using maximum contents of C, Si, Mn, and Cr obtained by subjecting a region between specified positions to EPMA line analysis; and a pearlite area ratio in the region is 95% or more, $$Ceq(max)=[\%\ C(max)]+([\%\ Si(max)]/11)+([\%\ Mn(max)]/7)+([\%\ Cr(max)]/5.8) \quad (2)$$

where [% M(max)] is the maximum content of the element M.

8 Claims, 4 Drawing Sheets

(51) Int. Cl.

| | |
|---|---|
| ***C21D 8/00*** | (2006.01) |
| ***C21D 9/04*** | (2006.01) |
| ***C22C 38/02*** | (2006.01) |
| ***C22C 38/04*** | (2006.01) |

(52) U.S. Cl.
CPC ..... *C21D 8/005* (2013.01); *C21D 9/04* (2013.01); *C22C 38/02* (2013.01); *C22C 38/04* (2013.01); *C21D 2211/009* (2013.01)

(58) Field of Classification Search
CPC ..... C22C 38/02; C22C 38/04; C22C 38/18; C22C 38/34
USPC ..... 148/333
See application file for complete search history.

(56) References Cited

U.S. PATENT DOCUMENTS

| | | | | |
|---|---|---|---|---|
| 5,762,723 | A | 6/1998 | Ueda et al. | |
| 8,747,576 | B2 * | 6/2014 | Miyazaki | C22C 38/02 148/507 |
| 2011/0303756 | A1 | 12/2011 | Ueda et al. | |
| 2015/0136864 | A1 | 5/2015 | Ueda et al. | |
| 2016/0010188 | A1 | 1/2016 | Han et al. | |
| 2017/0101692 | A1 | 4/2017 | Kimura et al. | |
| 2017/0369975 | A1 * | 12/2017 | Ueda | C21D 9/46 |

FOREIGN PATENT DOCUMENTS

| | | | | | |
|---|---|---|---|---|---|
| JP | H08109439 | A | | 4/1996 | |
| JP | H08144016 | A | | 6/1996 | |
| JP | H08246100 | A | | 9/1996 | |
| JP | H08246101 | A | | 9/1996 | |
| JP | H10195601 | A | | 7/1998 | |
| JP | 2002069585 | A | | 3/2002 | |
| JP | 2003293086 | A | | 10/2003 | |
| JP | 2004223531 | A | * | 8/2004 | C21D 9/04 |
| JP | 2007291418 | A | | 11/2007 | |
| JP | 2008013811 | A | | 1/2008 | |
| JP | 2010077481 | A | | 4/2010 | |
| JP | 2016053191 | A | | 4/2016 | |
| JP | 2016156071 | A | | 9/2016 | |
| WO | 2015146150 | A1 | | 10/2015 | |

OTHER PUBLICATIONS

Jun. 18, 2019, International Search Report issued in the International Patent Application No. PCT/JP2019/013864.

May 11, 2021, Office Action issued by the China National Intellectual Property Administration in the corresponding Chinese Patent Application No. 201980022411.1 with English language search report.

May 20, 2021, Office Action issued by the IP Australia in the corresponding Australian Patent Application No. 2019242156.

Aug. 25, 2021, Office Action issued by the China National Intellectual Property Administration in the corresponding Chinese Patent Application No. 201980022411.1 with English language concise statement of relevance.

Sep. 28, 2021, Office Action issued by the Canadian Intellectual Property Office in the corresponding Canadian Patent Application No. 3,094,798.

Nov. 26, 2020, the Extended European Search Report issued by the European Patent Office in the corresponding European Patent Application No. 19776513.4.

Feb. 10, 2022, Office Action issued by the China National Intellectual Property Administration in the corresponding Chinese Patent Application No. 201980022411.1 with English language concise statement of relevance.

* cited by examiner

RAIL AND METHOD FOR MANUFACTURING SAME

TECHNICAL FIELD

This disclosure relates to a rail, particularly a rail having both improved wear resistance and improved fatigue damage resistance, and to a method of manufacturing a rail with which the rail can be advantageously manufactured.

BACKGROUND

In heavy haul railways mainly built to transport ore, the load applied to the axle of a freight car is much higher than that in passenger cars, and rails are used in increasingly harsh environments. Conventionally, steels having a pearlite microstructure have been mainly used for the rails used under such circumstances from the viewpoint of the importance of wear resistance. In recent years, however, in order to improve the efficiency of transportation by railways, the loading weight on freight cars is becoming larger and larger, and consequently, there is a need for further improvement of wear resistance and fatigue damage resistance. Note that heavy haul railways are railways where trains and freight cars haul large loads (loading weight is about 150 tons or more, for example).

In order to further improve the wear resistance of the rail, for example, it has been proposed to increase the C content to increase the cementite fraction, thereby improving the wear resistance, such as increasing the C content to more than 0.85 mass % and 1.20 mass % or less, like JP H08-109439 A (PTL 1) and JP H08-144016 A (PTL 2), or increasing the C content to more than 0.85 mass % and 1.20 mass % or less and subjecting a rail head to heat treatment, like JP H08-246100 A (PTL 3) and JP H08-246101 A (PTL 4).

On the other hand, because the rails in a curved section of heavy haul railways are applied with rolling contact loading caused by wheels and sliding force caused by centrifugal force, wear of the rails is more severe than other sections, and fatigue damage occurs due to sliding. If it is simply setting the C content to more than 0.85 mass % and 1.20 mass % or less as proposed above, a pro-eutectoid cementite microstructure is formed depending on heat treatment conditions, and the number of cementite layers of a brittle pearlite lamellar microstructure is increased. As a result, the fatigue damage resistance cannot be improved.

Therefore, JP 2002-69585 A (PTL 5) proposes a technique of adding Al and Si to suppress the formation of pro-eutectoid cementite, thereby improving the fatigue damage resistance. However, it is difficult to satisfy both the wear resistance and the fatigue damage resistance in a steel rail having a pearlite microstructure, because the addition of Al leads to the formation of oxides that are the initiation point of fatigue damage.

JP H10-195601 A (PTL 6) improves the service life of the rail by setting the Vickers hardness of a region of at least 20 mm deep from the surface of a head corner and a head top of a rail to 370 HV or more. JP 2003-293086 A (PTL 7) controls pearlite block size to obtain a hardness in a region of at least 20 mm deep from the surface of a head corner and a head top of a rail within a range of 300 HV or more and 500 HV or less, thereby improving the service life of the rail.

CITATION LIST

Patent Literature

PTL 1: JP H08-109439 A
PTL 2: JP H08-144016 A

PTL 3: JP H08-246100 A
PTL 4: JP H08-246101 A
PTL 5: JP 2002-69585 A
PTL 6: JP H10-195601 A
PTL 7: JP 2003-293086 A

SUMMARY

Technical Problem

However, the rails are used in increasingly harsh environments, and in order to improve the service life of the rail, it has been a problem to further increase the hardness and expand the range of the hardening depth. It could thus be helpful to provide a rail having both excellent wear resistance and excellent fatigue damage resistance as well as a method of manufacturing the same.

Solution to Problem

In order to solve the problem, we prepared rails having different C, Si, Mn, and Cr contents, and intensely investigated their microstructure, wear resistance, and fatigue damage resistance. As a result, we discovered that, by optimizing a local equivalent carbon content (hereinafter referred to as Ceq(max)) caused by microsegregation, suppressing the formation of martensite and bainite microstructures in the local area, and increasing the hardness at least in a region between a position where a depth from a surface of a rail head is 1 mm and the position where the depth is 25 mm (hereinafter, also referred to as surface layer region), it is possible to improve both the wear resistance and the fatigue damage resistance compared to conventional rail materials. Specifically, we discovered that the effect of improving the wear resistance and the fatigue damage resistance can be stably maintained by making a Ceq calculated from the content of each component of C, Si, Mn and Cr within the range of 1.04 or more and 1.25 or less, subjecting a region between a position where a depth from a surface of a rail head is 1 mm and a position where the depth is 25 mm to line analysis with EPMA, and controlling a Ceq(max) determined from the maximum content of each component of C, Si, Mn and Cr in this region to 1.40 or less.

The present disclosure is based on the above discoveries and primary features thereof are as follows.

1. A rail comprising a chemical composition containing (consisting of)

C: 0.70 mass % or more and 1.00 mass % or less,
Si: 0.50 mass % or more and 1.60 mass % or less,
Mn: 0.20 mass % or more and 1.00 mass % or less,
P: 0.035 mass % or less,
S: 0.012 mass % or less, and
Cr: 0.40 mass % or more and 1.30 mass % or less, where a Ceq value defined by the following formula (1) is in a range of 1.04 or more and 1.25 or less, $$Ceq=[\%\ C]+([\%\ Si]/11)+([\%\ Mn]/7)+([\%\ Cr]/5.8) \quad (1)$$

where [% M] is the content in mass % of the element M, the balance being Fe and inevitable impurities, wherein Vickers hardness of a region between a position where a depth from a surface of a rail head is 1 mm and a position where the depth is 25 mm is 370 HV or more and less than 520 HV; a Ceq(max) is 1.40 or less, where the Ceq(max) is determined by the following formula (2) using a maximum content of each component of C, Si, Mn, and Cr, which are obtained by subjecting the region to line analysis with EPMA; and a pearlite area ratio in the region is 95% or more, $$Ceq(max)=[\%\ C(max)]+([\%\ Si(max)]/11)+([\%\ Mn(max)]/7)+([\%\ Cr(max)]/5.8) \quad (2)$$

where [% M(max)] is the maximum content of the element M obtained by line analysis with EPMA.

2. The rail according to the above 1., wherein the chemical composition further contains at least one selected from the group consisting of V: 0.30 mass % or less, Cu: 1.0 mass % or less, Ni: 1.0 mass % or less, Nb: 0.05 mass % or less, and Mo: 0.5 mass % or less.

3. The rail according to the above 1 or 2, wherein the chemical composition further contains at least one selected from the group consisting of Al: 0.07 mass % or less, W: 1.0 mass % or less, B: 0.005 mass % or less, Ti: less than 0.010 mass %, and Sb: 0.05 mass % or less.

4. A method of manufacturing a rail, comprising heating a steel material having the chemical composition according to any one of the above 1. to 3. to a temperature range of higher than 1150° C. and 1350° C. or lower, holding the steel material in the above-mentioned temperature range for a holding time of A in seconds or longer, where the A being defined by the following formula (3), and then subjecting the steel material to hot rolling where a rolling finish temperature is 850° C. or higher and 950° C. or lower, and then to cooling where a cooling start temperature is equal to or higher than a pearlite transformation start temperature, a cooling stop temperature is 400° C. or higher and 600° C. or lower, and a cooling rate is 1° C./s or higher and 5° C./s or lower, $$A(s)=\exp\{(6000/T)+(1.2\times[\%\ C])+(0.5\times[\%\ Si])+(2\times[\%\ Mn])+(1.4\times[\%\ Cr])\} \quad (3)$$

where T is a heating temperature [° C.], and [% M] is the content in mass % of the element M.

Advantageous Effect

According to the present disclosure, it is possible to stably manufacture a rail with high internal hardness having far superior wear resistance and fatigue damage resistance as compared with conventional rails. It contributes to a long service life of rails for heavy haul railways and prevention of railway accidents, which is beneficial in industrial terms.

DETAILED DESCRIPTION

Figure 1:
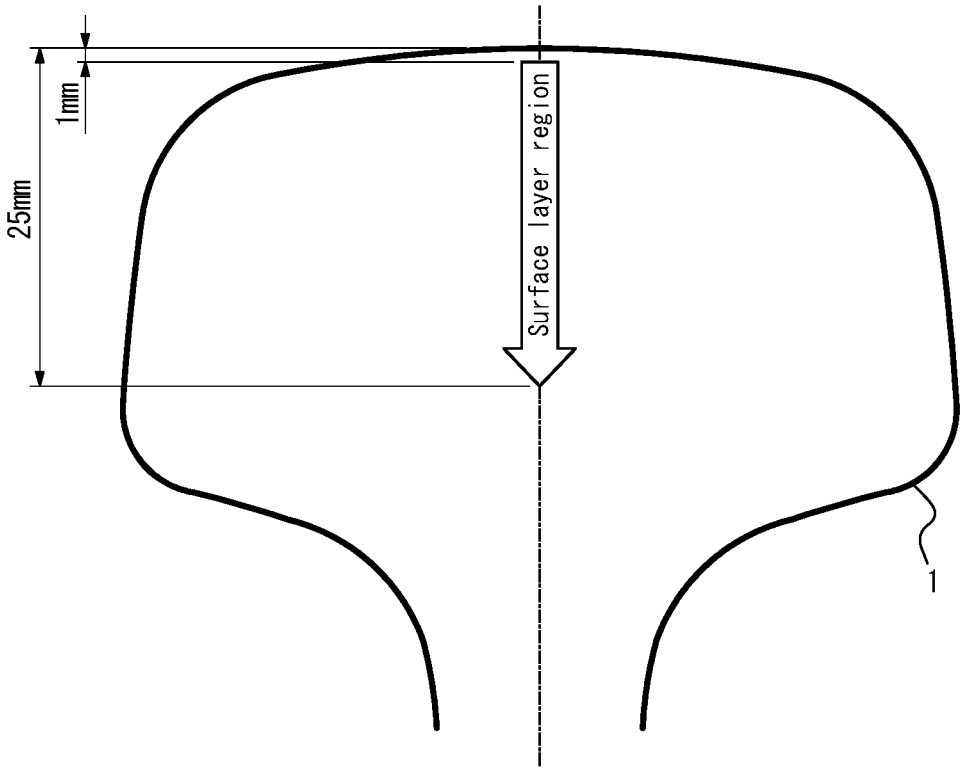
FIG. 1 is a cross-sectional view of a rail head indicating the measurement position of EPMA line analysis.

The following describes the present disclosure in detail. The reasons why the present disclosure limits the chemical composition of the rail steel to the above ranges are described first.

C: 0.70 mass % or more and 1.00 mass % or less

C is an essential element for forming cementite in a pearlite microstructure and ensuring wear resistance, and the wear resistance improves as the content of C increases. However, when the C content is less than 0.70 mass %, it is difficult to obtain excellent wear resistance as compared with a conventional heat-treated pearlite steel rail. In addition, when the C content exceeds 1.00 mass %, pro-eutectoid cementite is formed at austenite grain boundaries at the time of transformation after the hot rolling, and the fatigue damage resistance is remarkably decreased. Therefore, the C content is 0.70 mass % or more and 1.00 mass % or less. The C content is preferably 0.75 mass % or more and 0.85 mass % or less.

Si: 0.50 mass % or more and 1.60 mass % or less

Si is a deoxidizer and an element that strengthens a pearlite microstructure. Therefore, it should be contained at a content of 0.50 mass % or more. However, when the content exceeds 1.60 mass %, the weldability is deteriorated due to the high bonding strength between Si and oxygen. Further, Si highly improves the hardenability of the steel, so that a martensite microstructure is likely to be formed in the surface layer of the rail. Therefore, the Si content is 0.50 mass % or more and 1.60 mass % or less. The Si content is preferably 0.50 mass % or more and 1.20 mass % or less.

Mn: 0.20 mass % or more and 1.00 mass % or less

Mn lowers the pearlite transformation temperature and refines the lamellar spacing, thereby increasing the strength and the ductility of the rail with high internal hardness. However, when Mn is excessively contained in the steel, the equilibrium transformation temperature of pearlite is lowered, and as a result, the degree of supercooling is reduced and the lamellar spacing is coarsened. When the Mn content is less than 0.20 mass %, the effect of increasing the strength and the ductility cannot be sufficiently obtained. On the other hand, when the Mn content exceeds 1.00 mass %, a martensite microstructure is likely to be formed, and the material is likely to be deteriorated due to hardening and brittleness occurred during the heat treatment and welding of the rail. Further, the equilibrium transformation temperature is lowered even if a pearlite microstructure is formed, which coarsens the lamellar spacing. Therefore, the Mn content is 0.20 mass % or more and 1.00 mass % or less. The Mn content is preferably 0.20 mass % or more and 0.80 mass % or less.

P: 0.035 mass % or less

When the P content exceeds 0.035 mass %, the ductility is deteriorated. Therefore, the P content is 0.035 mass % or less. The P content is preferably 0.020 mass % or less. On the other hand, the lower limit of the P content is not particularly limited and may be 0 mass %. However, it is generally more than 0 mass % industrially. Because excessive reduction of P content causes an increase in refining cost, the P content is preferably 0.001 mass % or more from the viewpoint of economic efficiency.

S: 0.012 mass % or less

S is mainly present in the steel in the form of A type inclusions. When the S content exceeds 0.012 mass %, the amount of the inclusions is significantly increased, and at the same time coarse inclusions are formed. As a result, the cleanliness of the steel is deteriorated. Therefore, the S content is 0.012 mass % or less. The S content is preferably 0.010 mass % or less. The S content is more preferably 0.008 mass % or less. On the other hand, the lower limit of the S content is not particularly limited and may be 0 mass %. However, it is generally more than 0 mass % industrially. Because excessive reduction of S content causes an increase in refining cost, the S content is preferably 0.0005 mass % or more from the viewpoint of economic efficiency.

Cr: 0.40 mass % or more and 1.30 mass % or less

Cr raises the pearlite equilibrium transformation temperature and contributes to the refinement of the lamellar spacing, and at the same time, further improves the strength by solid solution strengthening. However, when the Cr content is less than 0.40 mass %, enough internal hardness cannot be obtained. On the other hand, when the Cr content is more than 1.30 mass %, the hardenability of the steel is increased, and martensite is likely to be formed. When the manufacture is performed under conditions where no martensite is formed, pro-eutectoid cementite is formed at prior austenite grain boundaries. As a result, the wear resistance and the fatigue damage resistance are decreased. Therefore, the Cr content is 0.40 mass % or more and 1.30 mass % or less. The Cr content is preferably 0.60 mass % or more and 1.20 mass % or less.

Ceq: 1.04 or more and 1.25 or less

The Ceq value is a value calculated by the following formula (1), where the content (mass %) of the element M in the steel is expressed as [% M]. That is, the Ceq value can be calculated with the C content being [% C] (mass %), the Si content being [% Si] (mass %), the Mn content being [% Mn] (mass %), and the Cr content being [% Cr] (mass %) in the following formula (1).

$$Ceq=[\%\ C]+([\%\ Si]/11)+([\%\ Mn]/7)+([\%\ Cr]/5.8) \quad (1)$$

The Ceq value is used to estimate the maximum hardness and weldability that can be obtained from the mix proportion of alloy components. In the present disclosure, the Ceq value is used as an index for suppressing the formation of martensite and bainite in the surface layer region of the rail, and it is necessary to maintain the Ceq value in an appropriate range. That is, when the Ceq value is less than 1.04, the internal hardness is insufficient, and the wear resistance and the fatigue damage resistance cannot be further improved. Further, when the Ceq value exceeds 1.25, the hardenability of the rail is increased, and martensite and bainite are likely to be formed in the surface layer region of the rail head. Therefore, the Ceq value is 1.04 or more and 1.25 or less. It is more preferably 1.04 or more and 1.20 or less.

The chemical composition of the rail of the present disclosure may optionally contain, in addition to the above-described components, either or both of at least one selected from the following Group A and at least one selected from the following Group B.

Group A: V: 0.30 mass % or less, Cu: 1.0 mass % or less, Ni: 1.0 mass % or less, Nb: 0.05 mass % or less, and Mo: 0.5 mass % or less Group B: Al: 0.07 mass % or less, W: 1.0 mass % or less, B: 0.005 mass % or less, Ti: less than 0.010 mass %, and Sb: 0.05 mass % or less The following describes the reasons for specifying the contents of the elements of the above Group A and Group B.

[Group A]

V: 0.30 mass % or less

V forms carbonitrides in the steel and disperses and precipitates in the matrix, thereby improving the wear resistance of the steel. However, when the V content exceeds 0.30 mass %, the workability deteriorates and the manufacturing cost increases. In addition, when the V content exceeds 0.30 mass %, the alloy cost increases. As a result, the cost of the rail with high internal hardness increases. Therefore, V may be contained with the upper limit being 0.30 mass %. Note that the V content is preferably 0.001 mass % or more in order to exhibit the effect of improving the wear resistance. The V content is more preferably in the range of 0.001 mass % or more and 0.150 mass % or less.

Cu: 1.0 mass % or less

Cu is an element capable of further strengthening the steel by solid solution strengthening, as with Cr. However, when the Cu content exceeds 1.0 mass %, Cu cracking is likely to occur. Therefore, when the chemical composition contains Cu, the Cu content is preferably 1.0 mass % or less. The Cu content is more preferably 0.005 mass % or more and 0.500 mass % or less.

Ni: 1.0 mass % or less.

Ni is an element that can increase the strength of the steel without deteriorating the ductility. In addition, in the case where the chemical composition contains Cu, it is preferable to add Ni because Cu cracking can be suppressed by the addition of Ni in combination with Cu. However, when the Ni content exceeds 1.0 mass %, the hardenability of the steel is further increased, the amount of martensite and bainite formed is increased, and the wear resistance and the fatigue damage resistance tend to be decreased. Therefore, when Ni is contained, the Ni content is preferably 1.0 mass % or less. The Ni content is more preferably 0.005 mass % or more and 0.500 mass % or less.

Nb: 0.05 mass % or less

Nb precipitates as carbides by combining with C in the steel during and after the hot rolling for shaping the steel into a rail, which effectively reduces the size of pearlite colony. As a result, the wear resistance, the fatigue damage resistance, and the ductility are greatly improved, which greatly extends the service life of the rail with high internal hardness. However, when the Nb content exceeds 0.05 mass %, the effect of improving the wear resistance and the fatigue damage resistance is saturated, and the effect does not increase as the content increases. Therefore, Nb may be contained with the upper limit being 0.05 mass %. When the Nb content is less than 0.001 mass %, it is difficult to obtain a sufficient effect of extending the service life of the rail. Therefore, when Nb is contained, the Nb content is preferably 0.001 mass % or more. The Nb content is more preferably 0.001 mass % or more and 0.030 mass % or less.

Mo: 0.5 mass % or less

Mo is an element capable of further strengthening the steel by solid solution strengthening. However, when the Mo content exceeds 0.5 mass %, the amount of bainite formed in the steel is increased, and the wear resistance is decreased. Therefore, when the chemical composition of the rail contains Mo, the Mo content is preferably 0.5 mass % or less. The Mo content is more preferably 0.005 mass % or more and 0.300 mass % or less.

[Group B]

Al: 0.07 mass % or less

Al is an element that can be added as a deoxidizer. However, when the Al content exceeds 0.07 mass %, a large amount of oxide-based inclusions is formed in the steel due to the high bonding strength between Al and oxygen. As a result, the ductility of the steel is decreased. Therefore, the Al content is preferably 0.07 mass % or less. On the other hand, the lower limit of the Al content is not particularly limited. However, it is preferably 0.001 mass % or more for deoxidation. The Al content is more preferably 0.001 mass % or more and 0.030 mass % or less.

W: 1.0 mass % or less

W precipitates as carbides during and after the hot rolling for shaping the steel into a rail shape, and improves the strength and the ductility of the rail by precipitation strengthening. However, when the W content exceeds 1.0 mass %, martensite is formed in the steel. As a result, the ductility is decreased. Therefore, when W is added, the W content is preferably 1.0 mass % or less. On the other hand, the lower limit of the W content is not particularly limited, yet the W content is preferably 0.001 mass % or more in order to exert the effect of improving the strength and the ductility. The W content is more preferably 0.005 mass % or more and 0.500 mass % or less.

B: 0.005 mass % or less

B precipitates as nitrides in the steel during and after the hot rolling for shaping the steel into a rail shape, and improves the strength and the ductility of the steel by precipitation strengthening. However, when the B content exceeds 0.005 mass %, martensite is formed. As a result, the ductility of the steel is decreased. Therefore, when B is contained, the B content is preferably 0.005 mass % or less. On the other hand, the lower limit of the B content is not particularly limited, yet the B content is preferably 0.001 mass % or more in order to exert the effect of improving the strength and the ductility. The B content is more preferably 0.001 mass % or more and 0.003 mass % or less.

Ti: less than 0.010 mass %

Ti precipitates as carbides, nitrides, or carbonitrides in the steel during and after the hot rolling for shaping the steel into a rail shape, and improves the strength and the ductility of the steel by precipitation strengthening. However, when the Ti content is 0.010 mass % or more, coarse carbides, nitrides or carbonitrides are formed. As a result, the fatigue damage resistance is decreased. Therefore, when Ti is contained, the Ti content is preferably less than 0.010 mass %. On the other hand, the lower limit of the Ti content is not particularly limited, yet the Ti content is preferably 0.001 mass % or more in order to exert the effect of improving the strength and the ductility. The Ti content is more preferably 0.005 mass % or more and 0.009 mass % or less.

Sb: 0.05 mass % or less

Sb has a remarkable effect of preventing the decarburization of the steel when reheating the rail steel material in a heating furnace before the hot rolling. However, when the Sb content exceeds 0.05 mass %, the ductility and the toughness of the steel are adversely affected. Therefore, when Sb is contained, the Sb content is preferably 0.05 mass % or less. On the other hand, the lower limit of the Sb content is not particularly limited, yet the Sb content is preferably 0.001 mass % or more in order to exert the effect of reducing a decarburized layer. The Sb content is more preferably 0.005 mass % or more and 0.030 mass % or less.

The chemical composition of the steel as the material of the rail of the present disclosure contains the above components and Fe and inevitable impurities as the balance. The balance preferably consists of Fe and inevitable impurities. The present disclosure also includes rails that contain other trace elements within a range that does not substantially affect the effects of the present disclosure instead of a part of the balance Fe in the chemical composition of the present disclosure. As used herein, examples of the inevitable impurities include P, N, O, and the like. As described above, a P content up to 0.035 mass % is allowable. In addition, a N content up to 0.008 mass % is allowable, and an O content up to 0.004 mass % is allowable.

In addition to using a steel having the above chemical composition as the rail material, it is also important that, for a surface layer region of a rail head, that is, a region between a position where a depth from a surface of the rail head is 1 mm and a position where the depth is 25 mm, the Vickers hardness be controlled within a specific range, the segregation of C, Si, Mn, and Cr be suppressed, and the area ratio of pearlite in the steel microstructure of the surface layer region be high, which will be described below.

Vickers hardness in surface layer region: 370 HV or more and less than 520 HV

When the Vickers hardness of the surface layer region, that is, a region between a position where a depth from a surface of the rail head is 1 mm and a position where the depth is 25 mm, is less than 370 HV, the wear resistance of the steel is decreased, and the service life of the steel rail with high internal hardness is shortened. On the other hand, when the Vickers hardness is 520 HV or more, the fatigue damage resistance of the steel is decreased due to the formation of martensite. Therefore, the Vickers hardness of the above-described region of the rail head is 370 HV or more and less than 520 HV. The Vickers hardness of the surface layer region of the rail head is specified because the performance of the surface layer region of the rail head controls the performance of the rail. The Vickers hardness of the surface layer region is preferably 400 HV or more and less than 480 HV.

With regard to segregation, because the degree of segregation can be evaluated by Ceq(max) described below, the range of the Ceq(max) in the present disclosure is specified as follows.

Ceq(max): 1.40 or less

Ceq(max) is a value determined by the following formula (2) from the maximum content of each component of C, Si, Mn, and Cr obtained by subjecting the surface layer region of the rail head to line analysis with EPMA. Generally, a steel ingot after continuous casting has a segregated portion of alloying elements generated in a solidification process. Since the hardenability is improved in the segregated portion because of the concentration of the alloy components, martensite and bainite are more likely to be formed in the segregated portion than in surrounding non-segregated portions. Pearlite, martensite, and bainite microstructures that are usually observed in rail materials can be identified by optical microscope observation. However, when martensite and bainite microstructures are formed in minute areas due to microsegregation, it was extremely difficult to accurately quantify them by optical microscope observation. With this respect, it has been found that, by controlling the value of the macroscopic Ceq calculated from the content of each alloying element described above and the value of the microscopic Ceq(max) determined from the maximum value of each component obtained by subjecting the surface layer region of the rail head to line analysis with EPMA, it is possible to suppress martensite and bainite microstructures in minute areas, which is extremely difficult to identify by microstructure observation under an ordinary optical microscope. Specifically, when the Ceq(max) value exceeds 1.40, martensite and bainite are locally formed, and the wear resistance and the fatigue damage resistance cannot be improved. Therefore, the Ceq(max) value is 1.40 or less. It is preferably 1.30 or less. On the other hand, the lower limit of the Ceq(max) value is not particularly limited. However, the Ceq(max) value is preferably 1.10 or more in order to secure excellent wear resistance and fatigue damage resistance by increasing the hardness of a pearlite microstructure.

$$Ceq(max)=[\%\ C(max)]+([\%\ Si(max)]/11)+([\%\ Mn(max)]/7)+([\%\ Cr(max)]/5.8) \quad (2)$$

where [% M(max)] is the maximum content of the element M obtained by line analysis with EPMA.

Pearlite area ratio in surface layer region: 95% or more

Further, the area fraction of pearlite in the microstructure of the surface layer region of the rail head should be 95% or more. The wear resistance and the fatigue damage resistance of the steel vary greatly depending on the microstructure, among which a pearlite microstructure has superior wear resistance and fatigue damage resistance compared to a martensitic microstructure and a bainite microstructure of the same hardness. In order to stably improve these properties required for the rail material, it is necessary to secure a pearlite microstructure having an area ratio of 95% or more in the surface layer region described above. It is more preferably 98% or more and may be 100%. As used herein, the pearlite area ratio is a pearlite area ratio obtained by observing the microstructure under an ordinary optical microscope.

Next, a method of manufacturing the above-described rail of the present disclosure will be described.

That is, the rail of the present disclosure can be manufactured by heating a steel material having the chemical composition described above to a temperature range of higher than 1150° C. and 1350° C. or lower, holding the steel material in the temperature range for a holding time of A (s) defined by the following formula (3) or longer, and then subjecting the steel material to hot rolling where a rolling finish temperature is 850° C. or higher and 950° C. or lower, and then to cooling where a cooling start temperature is equal to or higher than a pearlite transformation start temperature, a cooling stop temperature is 400° C. or higher and 600° C. or lower, and a cooling rate is 1° C./s or higher and 5° C./s or lower, $$A(s)=\exp\{(6000/T)+((1.2\times[\%\ C])+(0.5\times[\%\ Si])+(2\times[\%\ Mn])+(1.4\times[\%\ Cr]))\} \quad (3)$$

where T is the heating temperature [° C.], and [% M] is the content (mass %) of the element M.

The following describes the manufacturing conditions.

Heating temperature: higher than 1150° C. and 1350° C. or lower

When the heating temperature prior to the hot rolling is 1150° C. or lower, the deformation resistance during the rolling cannot be sufficiently reduced. On the other hand, when the heating temperature is higher than 1350° C., the steel material partially melts, which may cause defects inside the rail. Therefore, the heating temperature before the rail rolling is higher than 1150° C. and 1350° C. or lower. It is preferably 1200° C. or higher and 1300° C. or lower.

Holding time: A (s) defined by the above formula (3) or longer

During the manufacture of the rail, it is necessary to reduce the degree of segregation of alloying elements generated during the solidification process. During the heating prior to the hot rolling, it is possible to diffuse the segregation element and reduce the degree of segregation by holding the steel material in the above heating temperature range, yet the holding time depends on the contents of C, Si, Mn and Cr. We examined the holding time according to the contents of these elements and found that the holding time should be equal to or longer than the A value (s) calculated by the above formula (3). That is, when the actual heating holding time does not satisfy the A value calculated from the above formula (3), the effect of reducing segregation is poor, and the Ceq(max) value is high. As a result, a martensite or bainite microstructure is locally formed, and it is impossible to obtain stable and excellent wear resistance and fatigue damage resistance. Therefore, the heating holding time is equal to or longer than A(s) calculated by the above formula (3), which is composed of parameters according to the heating temperature T(° C.) and the contents of C, Si, Mn and Cr in the chemical composition of the steel. On the other hand, the upper limit of the holding time is not particularly limited. However, it is preferably 1.2 A or more and 2.0 A or less in order to prevent decrease of fatigue damage resistance due to coarsening.

Hot-rolling finish temperature: 850° C. or higher and 950° C. or lower

When the finish temperature of the hot rolling (hereinafter also simply referred to as "rolling finish temperature") is lower than 850° C., the rolling is performed to an austenite low temperature range. As a result, not only processing strain is introduced into austenite crystal grains, but also the elongation degree of austenite crystal grains becomes remarkable. Although the introduction of dislocations and an increase in the austenite grain boundary area increase the number of pearlite nucleation sites and reduce the size of pearlite colony, the increase in the number of pearlite nucleation sites raises the pearlite transformation start temperature and coarsens the lamellar spacing of pearlite. The coarsening of lamellar spacing of pearlite significantly decreases the rail wear resistance. On the other hand, if the rolling finish temperature exceeds 950° C., the austenite crystal grains are coarsened, which coarsens the size of finally obtained pearlite colony and decreases the fatigue damage resistance. Therefore, the rolling finish temperature is 850° C. or higher and 950° C. or lower. It is preferably 875° C. or higher and 925° C. or lower.

Cooling after hot rolling: cooling start temperature: equal to or high than a pearlite transformation start temperature; cooling stop temperature: 400° C. or higher and 600° C. or lower; cooling rate: 1° C./s or higher and 5° C./s or lower By subjecting the steel material after the hot rolling to cooling with the cooling start temperature being equal to or higher than a pearlite transformation start temperature, it is possible to obtain a rail having the hardness and the steel microstructure described above. In the case where the start temperature of the cooling is below the pearlite transformation start temperature or the cooling rate during the cooling is lower than 1° C./s, the lamellar spacing of the pearlite microstructure is coarsened and the internal hardness of the rail head is decreased. On the other hand, in the case where the cooling rate exceeds 5° C./s, a martensite microstructure or a bainite microstructure is formed, and the service life of the rail is shortened. Therefore, the cooling rate is in the range of 1° C./s or higher and 5° C./s or lower. It is preferably 2.5° C./s or higher and 4.5° C./s or lower. Although the pearlite transformation start temperature varies depending on the cooling rate, it refers to the equilibrium transformation temperature in the present disclosure. In the composition range of the present disclosure, if a cooling rate of the above range is adopted as a start when the temperature is 720° C. or higher, it can sufficiently satisfy to start the cooling at the cooling rate in the above range and from the temperature of or above the pearlite transformation start temperature. When the cooling stop temperature at the above cooling rate is lower than 400° C., the cooling time in a low temperature range is increased, which lowers the productivity and increases the cost of the rail. On the other hand, when the cooling stop temperature at the above cooling rate exceeds 600° C., the cooling stops when the temperature inside the rail head is at a temperature before the pearlite transformation occurs or during the pearlite transformation, which coarsens the lamellar spacing of the pearlite microstructure and shortens the service life of the rail. Therefore, the cooling stop temperature is 400° C. or higher and 600° C. or lower. It is preferably 450° C. or higher and 550° C. or lower.

EXAMPLES

The following describes the structures and function effects of the present disclosure in more detail, by way of examples. Note that the present disclosure is not restricted by any means to these examples and may be changed appropriately within the range conforming to the purpose of the present disclosure, all of such changes being included within the technical scope of the present disclosure.

Steel materials having the chemical compositions listed in Table 1 were subjected to hot rolling and, after the hot rolling, to cooling under the conditions listed in Table 2 to prepare rail materials. The cooling was performed only on a rail head, and it was allowed to cool after the cooling. The rolling finish temperature in Table 2 is a value obtained by measuring the temperature of the rail head side surface on the entrance side of a final rolling mill with a radiation thermometer. The cooling stop temperature is a value obtained by measuring the temperature of the rail head side surface layer with a radiation thermometer when the cooling stops. The cooling rate (° C./s) is obtained by converting the temperature change from the start of cooling to the stop of cooling into a value of per unit time (second). Note that the cooling start temperature in all examples is 720° C. or higher, which is equal to or higher than a pearlite transformation start temperature.

TABLE 1

| Steel | Chemical composition (mass %) | | | | | | | | | | | | | | | | | |
|---|---|---|---|---|---|---|---|---|---|---|---|---|---|---|---|---|---|---|
| No. | C | Si | Mn | P | S | Cr | V | Cu | Ni | Nb | Mo | Al | W | B | Ti | Sb | Ceq*2 | Remarks |
| 1 | 0.78 | 0.16 | 0.98 | 0.015 | 0.012 | 0.18 | — | — | — | — | — | — | — | — | — | — | 0.97 | Reference material |
| 2 | 0.72 | 0.74 | 0.98 | 0.011 | 0.007 | 0.63 | — | — | — | — | — | — | — | — | — | — | 1.04 | Conforming |
| 3 | 0.82 | 0.51 | 0.45 | 0.014 | 0.011 | 1.28 | — | — | — | — | — | — | — | — | — | — | 1.15 | steel |
| 4 | 0.78 | 0.99 | 0.72 | 0.033 | 0.006 | 0.67 | — | — | — | — | — | — | — | — | — | — | 1.09 | |
| 5 | 0.81 | 1.52 | 0.22 | 0.016 | 0.003 | 0.84 | — | — | — | — | — | — | — | — | — | — | 1.12 | |
| 6 | 0.80 | 1.11 | 0.55 | 0.013 | 0.005 | 0.93 | — | — | — | — | — | — | — | — | — | — | 1.14 | |
| 7 | 0.75 | 0.83 | 0.31 | 0.016 | 0.006 | 1.16 | — | — | — | — | — | — | — | — | — | — | 1.07 | |
| 8 | 0.82 | 0.58 | 0.61 | 0.015 | 0.005 | 0.84 | — | — | — | — | — | — | — | — | — | — | 1.10 | |
| 9 | 0.83 | 1.18 | 0.40 | 0.009 | 0.004 | 0.78 | — | — | — | — | — | — | — | — | — | — | 1.13 | |
| 10 | 0.81 | 0.95 | 0.52 | 0.008 | 0.005 | 0.81 | — | — | — | — | — | — | — | — | — | — | 1.11 | |
| 11 | 0.80 | 0.85 | 0.50 | 0.012 | 0.007 | 0.73 | — | — | — | — | — | — | — | — | — | — | 1.07 | |
| 12 | 0.79 | 1.37 | 0.71 | 0.026 | 0.003 | 0.42 | — | — | — | — | — | — | — | — | — | — | 1.09 | |
| 13 | 0.84 | 1.08 | 0.43 | 0.011 | 0.010 | 1.08 | — | — | — | — | — | — | — | — | — | — | 1.19 | |
| 14 | 0.83 | 1.01 | 0.62 | 0.016 | 0.009 | 0.85 | — | — | — | — | — | — | — | — | — | — | 1.16 | |
| 15 | 0.98 | 0.91 | 0.36 | 0.011 | 0.010 | 0.78 | — | — | — | — | — | — | — | — | — | — | 1.25 | |
| 16 | 0.82 | 0.64 | 0.71 | 0.010 | 0.008 | 1.00 | 0.08 | — | — | 0.023 | — | — | — | — | — | — | 1.15 | |
| 17 | 0.83 | 1.18 | 0.32 | 0.008 | 0.004 | 0.86 | | 0.36 | 0.18 | — | — | — | — | — | — | — | 1.13 | |
| 18 | 0.76 | 1.40 | 0.60 | 0.014 | 0.006 | 0.49 | — | — | — | — | 0.26 | — | — | — | — | — | 1.06 | |
| 19 | 0.80 | 0.91 | 0.45 | 0.016 | 0.010 | 1.23 | — | — | — | — | — | 0.027 | 0.2 | — | — | — | 1.16 | |
| 20 | 0.83 | 0.84 | 0.88 | 0.015 | 0.009 | 0.90 | — | — | — | — | — | — | — | 0.003 | 0.008 | — | 1.19 | |
| 21 | 0.78 | 1.43 | 0.91 | 0.009 | 0.005 | 0.74 | — | — | — | — | — | — | — | — | — | 0.03 | 1.17 | |
| 22 | 0.69 | 0.75 | 0.43 | 0.015 | 0.005 | 1.13 | — | — | — | — | — | — | — | — | — | — | 1.01 | Comparative |
| 23 | 1.01 | 0.90 | 0.33 | 0.018 | 0.010 | 0.64 | — | — | — | — | — | — | — | — | — | — | 1.25 | steel |
| 24 | 0.83 | 0.48 | 0.53 | 0.013 | 0.011 | 0.54 | — | — | — | — | — | — | — | — | — | — | 1.04 | |
| 25 | 0.80 | 1.61 | 0.71 | 0.009 | 0.009 | 1.21 | — | — | — | — | — | — | — | — | — | — | 1.26 | |
| 26 | 0.79 | 0.59 | 0.19 | 0.020 | 0.008 | 0.84 | — | — | — | — | — | — | — | — | — | — | 1.02 | |
| 27 | 0.81 | 0.75 | 1.03 | 0.010 | 0.004 | 1.29 | — | — | — | — | — | — | — | — | — | — | 1.25 | |
| 28 | 0.83 | 0.58 | 0.89 | 0.037 | 0.009 | 1.02 | — | — | — | — | — | — | — | — | — | — | 1.19 | |
| 29 | 0.85 | 0.55 | 0.61 | 0.020 | 0.014 | 0.97 | — | — | — | — | — | — | — | — | — | — | 1.15 | |
| 30 | 0.83 | 0.67 | 0.55 | 0.014 | 0.005 | 0.38 | — | — | — | — | — | — | — | — | — | — | 1.03 | |
| 31 | 0.82 | 0.77 | 0.49 | 0.012 | 0.006 | 1.33 | — | — | — | — | — | — | — | — | — | — | 1.19 | |
| 32 | 0.81 | 0.51 | 0.67 | 0.011 | 0.009 | 0.46 | — | — | — | — | — | — | — | — | — | — | 1.03 | |
| 33 | 0.78 | 0.50 | 0.60 | 0.015 | 0.005 | 0.40 | 0.05 | — | — | — | — | — | — | — | — | — | 0.98 | |
| 34 | 0.85 | 1.43 | 0.74 | 0.018 | 0.004 | 1.03 | — | — | — | — | — | — | — | — | — | — | 1.26 | |
| 35 | 0.99 | 0.56 | 0.50 | 0.012 | 0.006 | 0.40 | — | — | — | — | — | — | — | — | 0.012 | — | 1.18 | |
| 36 | 0.84 | 1.48 | 0.96 | 0.013 | 0.006 | 1.24 | — | — | — | 0.034 | — | — | — | — | — | 0.02 | 1.33 | |

*1 The underline indicates outside the applicable range.

*2 Ceq = [% C] + ([% Si]/11) + ([% Mn]/7) + ([% Cr]/5.8)

TABLE 2

| Test No. | Steel No. | Heating temperature: T [° C.] | A*2 [sec] | Holding time [sec] | Rolling finish temperature [° C.] | Cooling stop temperature [° C.] | Cooling rate [° C./sec] |
|---|---|---|---|---|---|---|---|
| 1 | 1 | 1250 | 3066 | 4000 | 900 | 550 | 2.5 |
| 2 | 2 | 1200 | 8743 | 10800 | 875 | 525 | 4.5 |
| 3 | 3 | 1300 | 5148 | 7200 | 925 | 550 | 2.8 |
| 4 | 4 | 1200 | 6694 | 9000 | 900 | 600 | 2.7 |
| 5 | 5 | 1150 | 5247 | 10800 | 900 | 550 | 3.2 |
| 6 | 6 | 1225 | 6734 | 7200 | 900 | 550 | 3.1 |
| 7 | 7 | 1350 | 2991 | 5400 | 950 | 500 | 3.0 |
| 8 | 8 | 1250 | 4770 | 7200 | 925 | 525 | 2.5 |

TABLE 2-continued

| Test No. | Steel No. | Heating temperature: T [° C.] | A*2 [sec] | Holding time [sec] | Rolling finish temperature [° C.] | Cooling stop temperature [° C.] | Cooling rate [° C./sec] |
|---|---|---|---|---|---|---|---|
| 9 | 9 | 1200 | 4808 | 9000 | 900 | 550 | 2.8 |
| 10 | 10 | 1300 | 3776 | 3800 | 900 | 550 | 2.6 |
| 11 | 11 | 1250 | 3667 | 7200 | 875 | 500 | 3.0 |
| 12 | 12 | 1200 | 5659 | 9000 | 900 | 550 | 3.2 |
| 13 | 13 | 1250 | 6124 | 10800 | 925 | 550 | 3.0 |
| 14 | 14 | 1250 | 6192 | 9000 | 950 | 525 | 2.5 |
| 15 | 15 | 1200 | 4642 | 7200 | 900 | 500 | 4.8 |
| 16 | 16 | 1150 | 11400 | 14400 | 900 | 550 | 2.9 |
| 17 | 17 | 1200 | 4583 | 9000 | 850 | 550 | 3.0 |
| 18 | 18 | 1250 | 4016 | 7200 | 875 | 550 | 3.1 |
| 19 | 19 | 1175 | 9352 | 10800 | 925 | 525 | 3.8 |
| 20 | 20 | 1225 | 11316 | 16200 | 900 | 500 | 3.6 |
| 21 | 21 | 1250 | 11015 | 14400 | 900 | 550 | 3.0 |
| 22 | 22 | 1200 | 5682 | 7200 | 900 | 550 | 3.0 |
| 23 | 23 | 1250 | 3035 | 9000 | 950 | 550 | 2.8 |
| 24 | 24 | 1250 | 2571 | 5400 | 900 | 500 | 3.5 |
| 25 | 25 | 1300 | 13285 | 14400 | 925 | 525 | 3.2 |
| 26 | 26 | 1250 | 1996 | 5400 | 900 | 525 | 3.0 |
| 27 | 27 | 1200 | 27255 | 28800 | 875 | 550 | 3.6 |
| 28 | 28 | 1250 | 4016 | 14400 | 925 | 525 | 3.9 |
| 29 | 29 | 1225 | 6444 | 9000 | 900 | 550 | 2.8 |
| 30 | 30 | 1250 | 2352 | 3600 | 900 | 500 | 3.4 |
| 31 | 31 | 1250 | 8193 | 10800 | 900 | 525 | 2.9 |
| 32 | 32 | 1300 | 2506 | 5400 | 900 | 550 | 3.0 |
| 33 | 33 | 1250 | 2312 | 7200 | 950 | 500 | 3.5 |
| 34 | 34 | 1200 | 15631 | 16200 | 900 | 550 | 3.4 |
| 35 | 35 | 1250 | 2510 | 5400 | 900 | 550 | 3.2 |
| 36 | 36 | 1250 | 27011 | 28800 | 925 | 550 | 2.9 |
| 37 | 2 | 1360 | 4855 | 7200 | 900 | 550 | 3.0 |
| 38 | 4 | 1250 | 5481 | 5400 | 900 | 550 | 3.2 |
| 39 | 10 | 1250 | 4541 | 4000 | 900 | 500 | 2.4 |
| 40 | 15 | 1200 | 4642 | 3600 | 900 | 550 | 4.0 |
| 41 | 8 | 1250 | 4770 | 7200 | 960 | 525 | 4.9 |
| 42 | 9 | 1200 | 4808 | 9000 | 840 | 500 | 3.0 |
| 43 | 5 | 1300 | 2874 | 5400 | 850 | 610 | 2.5 |
| 44 | 6 | 1250 | 6106 | 10800 | 900 | 550 | 0.5 |
| 45 | 7 | 1250 | 4268 | 7200 | 950 | 550 | 5.5 |

*1 The underline indicates outside the applicable range.

*2 $A = \exp\{(6000/T) + ((1.2 \times [\%\ C]) + (0.5 \times [\%\ Si]) + (2 \times [\%\ Mn]) + (1.4 \times [\%\ Cr]))\}$ The rails thus obtained were evaluated in terms of hardness of rail head, Ceq(max), pearlite area ratio, wear resistance, and fatigue damage resistance. The following describes the details of each evaluation.

Hardness of Rail Head

The Vickers hardness of the surface layer region (a region between a position where the depth from the surface of the rail head was 1 mm and a position where the depth was 25 mm) illustrated in FIG. 1 was measured at a load of 98 N and a pitch of 0.5 mm in the depth direction, and the maximum and minimum values of the hardness were obtained.

Ceq(max)

Line analysis was performed with EPMA for [% C], [% Si], [% Mn] and [% Cr] in the surface layer region of the rail head illustrated in FIG. 1, and the maximum value [% C(max)], [% Si(max)], [% Mn(max)], and [% Cr(max)] were obtained from the analysis results. The Ceq(max) was calculated from the above formula (2) based on these values. The line analysis was performed under the conditions of an accelerating voltage of 15 kV and a beam diameter of 1 μm.

Pearlite Area Ratio

With respect to the pearlite area ratio, test pieces were collected at positions of depths of 1 mm, 5 mm, 10 mm, 15 mm, 20 mm, and 25 mm from the surface of the rail head, respectively. Each of the collected test pieces was corroded with nital after polishing, a cross section of each test piece was observed under an optical microscope at 400 times to identify the type of microstructure, and the pearlite area ratio was evaluated by determining the ratio of the microstructure identified as pearlite to the observed area. That is, the area ratio of a pearlite microstructure in the surface layer region was evaluated by determining the ratio (in percentage) of the total area of the observed pearlite microstructure to the total value of the observed area at each position.

Wear Resistance

Figure 2A:
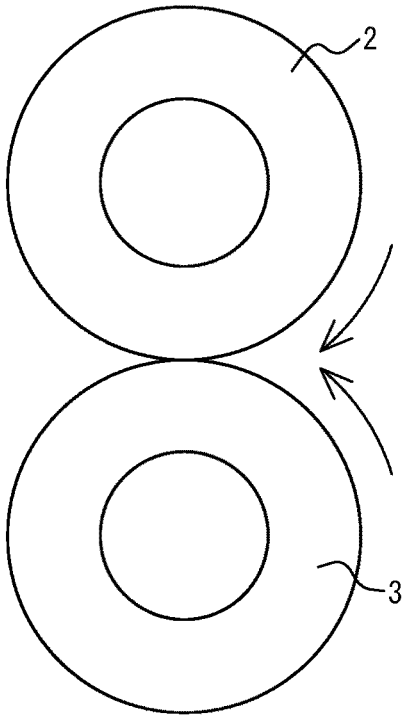
FIG. 2A is a plan view illustrating a Nishihara type wear test piece for evaluating wear resistance.
Figure 2B:
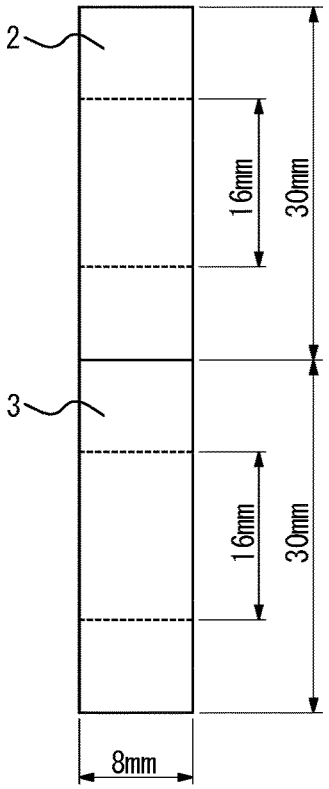
FIG. 2B is a side view illustrating the Nishihara type wear test piece for evaluating wear resistance.
Figure 3:
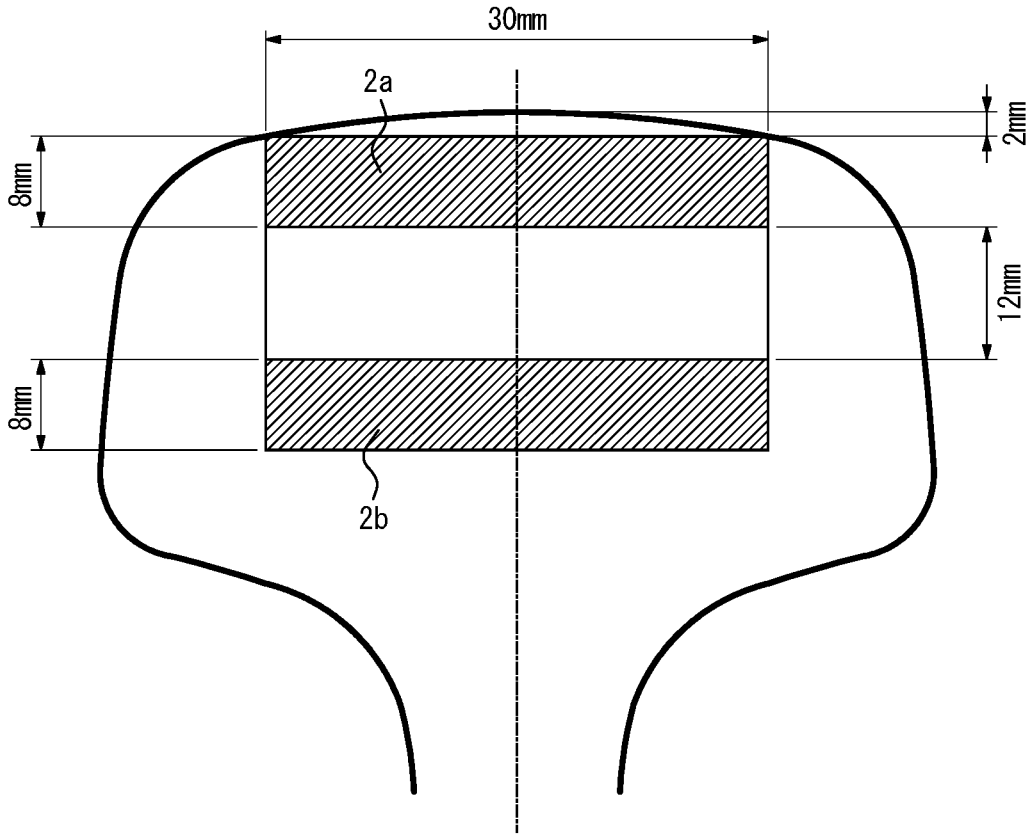
FIG. 3 is a cross-sectional view of a rail head indicating the collecting positions of Nishihara type wear test pieces.

It is most desirable to actually lay the rail to evaluate the wear resistance, yet this requires a long testing time. Therefore, in the present disclosure, the wear resistance was evaluated by a comparative test in which actual contact conditions between a rail and a wheel were simulated using a Nishihara type wear test apparatus that enables wear resistance evaluation in a short period of time. Specifically, a Nishihara type wear test piece 2 having an outer diameter of 30 mm as illustrated in FIGS. 2A and 2B was collected from the rail head, and the test piece 2 was brought into contact with a tire test piece 3 and rotated as illustrated in FIGS. 2A and 2B to conduct the test. The arrows in FIG. 2A indicate the rotation directions of the Nishihara type wear test piece 2 and the tire test piece 3, respectively. The tire test piece was obtained by collecting a round bar having a diameter of 32 mm from the head of a normal rail according to JIS standard E1101 where the Vickers hardness (load: 98N) was 390 HV, subjecting the round bar to heat treatment so that the microstructure turned into a tempered martensite microstructure, and then processing it into the shape illustrated in FIGS. 2A and 2B. The Nishihara type wear test pieces 2 were collected from two locations in the rail head 1 as illustrated in FIG. 3. The one collected at a position where the depth in the surface layer region of the rail head 1 was 5 mm was a Nishihara type wear test piece 2*a*, and the one collected at a position where the depth in the surface layer region was 25 mm was a Nishihara type wear test piece 2*b*. That is, the center in the longitudinal direction of the Nishihara type wear test piece 2*a* was located at a depth of 4 mm or more and 6 mm or less (average value: 5 mm) from the upper surface of the rail head 1, and the center in the longitudinal (axial) direction of the Nishihara type wear test piece 2*b* is located at a depth of 24 mm or more and 26 mm or less (average value 25 mm) from the upper surface of the rail head 1. The test was conducted under dry ambient conditions, and the amount of wear was measured after 100,000 rotations under conditions of a contact pressure of 1.4 GPa, a slip ratio of −10%, and a rotational speed of 675 rpm (tire test piece: 750 rpm). A heat-treated pearlite steel rail was used as a reference steel material when comparing the amounts of wear, and it was determined that the wear resistance was improved when the amount of wear was 10% or more less than that of the reference steel material. The wear resistance improvement margin was calculated using the sum of the amounts of wear of the Nishihara type wear test piece 2*a* and the Nishihara type wear test piece 2*b* by {(amount of wear of reference material−amount of wear of test material)/(amount of wear of reference material)}×100.

Fatigue Damage Resistance

Figure 4A:
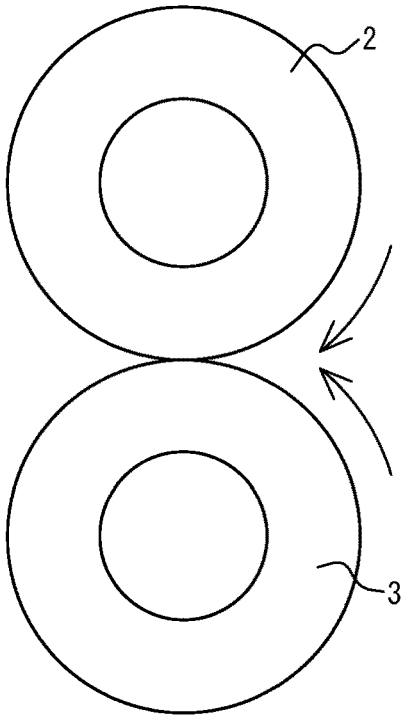
FIG. 4A is a plan view illustrating a Nishihara type wear test piece for evaluating fatigue damage resistance.
Figure 4B:
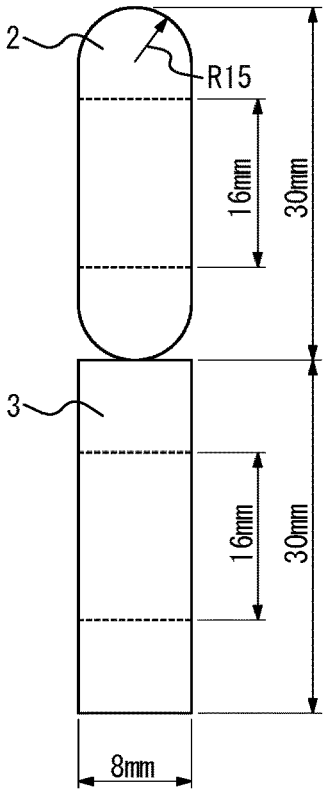
FIG. 4B is a side view illustrating the Nishihara type wear test piece for evaluating fatigue damage resistance.

With respect to the fatigue damage resistance, a Nishihara type wear test piece 2 having a diameter of 30 mm whose contact surface was a curved surface having a radius of curvature of 15 mm was collected from the rail head, and the test piece 2 was brought into contact with a tire test piece 3 and rotated as illustrated in FIGS. 4A and 4B to conduct the test. The arrows in FIG. 4A indicate the rotation directions of the Nishihara type wear test piece 2 and the tire test piece 3, respectively. The Nishihara type wear test pieces 2 were collected from two locations in the rail head 1 as illustrated in FIG. 3. The Nishihara type wear test pieces 2 and the tire test piece 3 were collected at the same positions as described above, and thus the description thereof is omitted. The test was conducted under oil lubrication conditions, where the contact pressure was 2.2 GPa, the slip ratio was −20%, and the rotational speed was 600 rpm (tire test piece: 750 rpm). The surface of the test piece was observed every 25,000 rotations, and the number of rotations at the time when a crack of 0.5 mm or more occurred was taken as the fatigue damage life. A heat-treated pearlite steel rail was used as a reference steel material when comparing the length of fatigue damage life, and it was determined that the fatigue damage resistance was improved when the fatigue damage time was longer by 10% or more than that of the reference steel material. The fatigue damage resistance improvement margin was calculated using the total value of the numbers of rotations until the occurrence of fatigue damage in the Nishihara type wear test piece 2*a* and the Nishihara type wear test piece 2*b* by [{(number of rotations until occurrence of fatigue damage in test material)−(number of rotations until occurrence of fatigue damage in reference material)}/(number of rotations until occurrence of fatigue damage in reference material)]×100

The results of the investigation are listed in Table 3. The test results of the rail materials prepared with the manufacturing method within the scope of the present disclosure (the heating temperature, the holding time, the rolling finish temperature, the cooling rate, and the cooling stop temperature) using a conforming steel satisfying the chemical composition of the present disclosure (Test Nos. 1 to 21 in Table 3) indicate that both the wear resistance and the fatigue damage resistance were improved by 10% or more with respect to the reference material, and they had had better wear resistance and fatigue damage resistance than Comparative Examples.

On the other hand, for Comparative Examples (Test Nos. 22 to 36 and Test Nos. 36 to 45 in Table 3), where the chemical composition of the rail material did not satisfy the conditions of the present disclosure or the manufacturing method within the scope of the present disclosure (the hot-rolling finish temperature, and the cooling rate and the cooling stop temperature after the hot rolling) was not used and consequently the examples did not satisfy the hardness, the Ceq(max), or the pearlite area ratio of the present disclosure, the improvement margin of at least one of the wear resistance and the fatigue damage resistance with respect to the reference material was lower than that of Examples. In Test No. 37, the heating temperature was too high, so that part of the steel material melted during the heating. For this reason, it could not be subjected to rolling because of fear of breakage during the rolling, and the properties could not be evaluated.

TABLE 3

| Test No. | Steel No. | Ceq (max)*2 | Microstructure*4 | Pearlite area ratio [%] | Hardness [Hv] Minimum | Hardness [Hv] Maximum | Rail head surface layer Amount of wear [g] |
|---|---|---|---|---|---|---|---|
| 1 | 1 | 1.08 | P | 100 | 339 | 380 | 1.12 |
| 2 | 2 | 1.25 | P + B | 99 | 403 | 486 | 0.92 |
| 3 | 3 | 1.32 | P + B | 98 | 410 | 473 | 0.93 |
| 4 | 4 | 1.14 | P | 100 | 412 | 468 | 0.95 |
| 5 | 5 | 1.28 | P + B | 99 | 424 | 480 | 0.91 |
| 6 | 6 | 1.33 | P + B | 98 | 429 | 472 | 0.92 |
| 7 | 7 | 1.13 | P | 100 | 398 | 481 | 0.95 |
| 8 | 8 | 1.20 | P | 100 | 412 | 469 | 0.93 |
| 9 | 9 | 1.25 | P + B | 99 | 408 | 476 | 0.91 |
| 10 | 10 | 1.18 | P | 100 | 395 | 473 | 0.94 |
| 11 | 11 | 1.20 | P + B | 99 | 384 | 458 | 0.96 |
| 12 | 12 | 1.30 | P + B | 98 | 421 | 480 | 0.95 |
| 13 | 13 | 1.29 | P + B | 99 | 415 | 469 | 0.97 |
| 14 | 14 | 1.36 | P + B | 97 | 421 | 479 | 0.94 |
| 15 | 15 | 1.39 | P + B | 95 | 407 | 498 | 0.99 |
| 16 | 16 | 1.25 | P | 100 | 418 | 476 | 0.95 |

TABLE 3-continued

| | | | | | | | |
|---|---|---|---|---|---|---|---|
| 17 | 17 | 1.18 | P | 100 | 413 | 470 | 0.97 |
| 18 | 18 | 1.14 | P | 100 | 406 | 472 | 0.99 |
| 19 | 19 | 1.28 | P + B | 98 | 425 | 492 | 0.96 |
| 20 | 20 | 1.33 | P + B | 98 | 420 | 485 | 0.92 |
| 21 | 21 | 1.31 | P + B | 97 | 410 | 479 | 0.98 |
| 22 | 22 | 1.10 | P | 100 | 324 | 389 | 1.04 |
| 23 | 23 | 1.37 | P + θ | 95 | 416 | 469 | 0.95 |
| 24 | 24 | 1.12 | P | 100 | 381 | 440 | 1.05 |
| 25 | 25 | 1.39 | P + B | 93 | 429 | 521 | 1.01 |
| 26 | 26 | 1.09 | P | 100 | 375 | 428 | 1.07 |
| 27 | 27 | 1.42 | P + B + M | 94 | 406 | 530 | 0.99 |
| 28 | 28 | 1.30 | P + B | 98 | 419 | 477 | 0.95 |
| 29 | 29 | 1.26 | P + B | 98 | 416 | 475 | 0.97 |
| 30 | 30 | 1.08 | P | 100 | 398 | 425 | 1.08 |
| 31 | 31 | 1.35 | P + B + M | 96 | 420 | 530 | 1.04 |
| 32 | 32 | 1.12 | P | 100 | 368 | 426 | 1.05 |
| 33 | 33 | 1.04 | P | 100 | 357 | 419 | 1.08 |
| 34 | 34 | 1.45 | P + B + M | 94 | 431 | 526 | 1.06 |
| 35 | 35 | 1.32 | P + B | 97 | 413 | 469 | 0.96 |
| 36 | 36 | 1.58 | P + B + M | 92 | 440 | 545 | 1.09 |
| 37*3 | 2 | — | — | — | — | — | — |
| 38 | 4 | 1.42 | P | 100 | 435 | 498 | 1.05 |
| 39 | 10 | 1.41 | P + B + M | 95 | 422 | 500 | 1.01 |
| 40 | 15 | 1.48 | P + B + M | 93 | 430 | 522 | 1.03 |
| 41 | 8 | 1.24 | P + B | 99 | 425 | 520 | 0.93 |
| 42 | 9 | 1.29 | P + B | 98 | 363 | 442 | 1.06 |
| 43 | 5 | 1.20 | P | 100 | 362 | 448 | 1.04 |
| 44 | 6 | 1.25 | P + B | 99 | 365 | 455 | 1.03 |
| 45 | 7 | 1.18 | P + B + M | 91 | 430 | 524 | 1.07 |

| | Rail head surface layer | 25 mm inside rail | | | | |
|---|---|---|---|---|---|---|
| Test No. | Number of rotations until occurrence of fatigue damage [×10^5] | Amount of wear [g] | Number of rotations until occurrence of fatigue damage [×10^5] | Wear resistance [%] | Fatigue damage resistance [%] | Remarks |
| 1 | 8.50 | 1.23 | 7.75 | — | — | Reference material |
| 2 | 9.75 | 1.13 | 8.50 | 12.8 | 12.3 | Example |
| 3 | 9.50 | 1.12 | 9.00 | 12.8 | 13.8 | |
| 4 | 9.25 | 1.14 | 8.75 | 11.1 | 10.8 | |
| 5 | 10.00 | 1.06 | 9.25 | 16.2 | 18.5 | |
| 6 | 10.50 | 1.04 | 9.50 | 16.6 | 23.1 | |
| 7 | 9.75 | 1.14 | 8.25 | 11.1 | 10.8 | |
| 8 | 10.00 | 1.10 | 9.50 | 13.6 | 20.0 | |
| 9 | 10.50 | 1.11 | 9.25 | 14.0 | 21.5 | |
| 10 | 10.25 | 1.13 | 9.25 | 11.9 | 20.0 | |
| 11 | 10.00 | 1.10 | 9.25 | 12.3 | 18.5 | |
| 12 | 10.25 | 1.06 | 9.50 | 14.5 | 21.5 | |
| 13 | 10.00 | 1.08 | 9.25 | 12.8 | 18.5 | |
| 14 | 9.75 | 1.05 | 8.75 | 15.3 | 13.8 | |
| 15 | 9.25 | 1.12 | 8.75 | 10.2 | 10.8 | |
| 16 | 10.25 | 1.09 | 9.00 | 13.2 | 18.5 | |
| 17 | 9.75 | 1.10 | 9.00 | 11.9 | 15.4 | |
| 18 | 9.50 | 1.12 | 8.75 | 10.2 | 12.3 | |
| 19 | 9.75 | 1.05 | 9.25 | 14.5 | 16.9 | |
| 20 | 10.00 | 1.06 | 9.25 | 15.7 | 18.5 | |
| 21 | 9.75 | 1.08 | 9.25 | 12.3 | 16.9 | |
| 22 | 9.25 | 1.15 | 8.50 | 6.8 | 9.2 | Comparative |
| 23 | 9.00 | 1.10 | 8.25 | 12.8 | 6.2 | Example |
| 24 | 9.50 | 1.16 | 8.50 | 6.0 | 10.8 | |
| 25 | 9.50 | 1.11 | 8.75 | 9.8 | 12.3 | |
| 26 | 9.25 | 1.16 | 8.25 | 5.1 | 7.7 | |
| 27 | 9.75 | 1.13 | 8.25 | 9.8 | 10.8 | |
| 28 | 9.50 | 1.10 | 8.25 | 12.8 | 9.2 | |
| 29 | 8.75 | 1.12 | 7.75 | 11.1 | 1.5 | |
| 30 | 9.25 | 1.12 | 8.50 | 6.4 | 9.2 | |
| 31 | 10.00 | 1.10 | 8.50 | 8.9 | 13.8 | |
| 32 | 9.25 | 1.15 | 8.25 | 6.4 | 7.7 | |
| 33 | 9.00 | 1.16 | 8.00 | 4.7 | 4.6 | |
| 34 | 9.50 | 1.09 | 8.50 | 8.5 | 10.8 | |
| 35 | 9.25 | 1.07 | 8.25 | 13.6 | 7.7 | |
| 36 | 9.25 | 1.15 | 8.00 | 4.7 | 6.2 | |
| 37*3 | — | — | — | — | — | |

TABLE 3-continued

| | | | | | |
|---|---|---|---|---|---|
| 38 | 9.75 | 1.09 | 8.50 | 8.9 | 12.3 |
| 39 | 9.25 | 1.12 | 8.75 | 9.4 | 10.8 |
| 40 | 9.00 | 1.14 | 8.50 | 7.7 | 7.7 |
| 41 | 8.75 | 1.12 | 8.25 | 12.8 | 4.6 |
| 42 | 9.50 | 1.16 | 8.75 | 5.5 | 12.3 |
| 43 | 9.25 | 1.15 | 8.50 | 6.8 | 9.2 |
| 44 | 9.50 | 1.14 | 8.50 | 7.7 | 10.8 |
| 45 | 9.25 | 1.11 | 8.25 | 7.2 | 7.7 |

* 1 The underline indicates outside the applicable range.
*2 Ceq(max) = [% C(max)] + ([% Si(max)]/11) + ([% Mn(max)]/7) + ([% Cr(max)]/5.8)
*3 Part of the steel material melted during the heating and the properties could not be evaluated.
*4 P: pearlite, B: bainite, M: martensite, θ: pro-eutectoid cementite

REFERENCE SIGNS LIST

1 rail head
2 Nishihara type wear test piece collected from a pearlite steel rail
2*a* Nishihara type wear test piece collected from the surface layer part of the rail head
2*b* Nishihara type wear test piece collected from the inside of the rail head
3 tire test piece

The invention claimed is:

1. A rail comprising a chemical composition containing consisting
C: 0.70 mass % or more and 1.00 mass % or less,
Si: 0.50 mass % or more and 1.60 mass % or less,
Mn: 0.20 mass % or more and 1.00 mass % or less,
P: 0.035 mass % or less,
S: 0.012 mass % or less, and
Cr: 0.40 mass % or more and 1.30 mass % or less, and
optionally, at least one selected from the group consisting of
Cu: 1.0 mass % or less,
Ni: 1.0 mass % or less,
Nb: 0.05 mass % or less,
Mo: 0.5 mass % or less,
Al: 0.07 mass % or less,
W: 1.0 mass % or less,
B: 0.005 mass % or less,
Ti: less than 0.010 mass %, and
Sb: 0.05 mass % or less,
where a Ceq value defined by the following formula (1) is in a range of 1.04 or more and 1.25 or less, $$Ceq=[\%\ C]+([\%\ Si]/11)+([\%\ Mn]/7)+([\%\ Cr]/5.8) \quad (1)$$

where [% M] is the content in mass % of the element M,
the balance being Fe and inevitable impurities, wherein
Vickers hardness of a region between a position where a depth from a surface of a rail head is 1 mm and a position where the depth is 25 mm is 370 HV or more and less than 520 HV; a Ceq(max) is 1.40 or less, where the Ceq(max) is determined by the following formula (2) using a maximum content of each component of C, Si, Mn, and Cr, which are obtained by subjecting the region to line analysis with EPMA, which stands for an Electron Probe Micro Analyzer; and a pearlite area ratio in the region is 95% or more, $$Ceq(max)=[\%\ C(max)]+([\%\ Si(max)]/11)+([\%\ Mn(max)]/7)+([\%\ Cr(max)]/5.8) \quad (2)$$

where [% M(max)] is the maximum content of the element M obtained by line analysis with EPMA.

2. A method of manufacturing a rail, comprising heating a steel material having the chemical composition according to claim 1 to a temperature range of higher than 1150° C. and 1350° C. or lower, holding the steel material in the temperature range for a holding time of A in seconds defined by the following formula (3) or longer, and then subjecting the steel material to hot rolling where a rolling finish temperature is 850° C. or higher and 950° C. or lower, and then to cooling where a cooling start temperature is equal to or higher than a pearlite transformation start temperature, a cooling stop temperature is 400° C. or higher and 600° C. or lower, and a cooling rate is 1° C./s or higher and 5° C./s or lower, $$A(s)=\exp\{(6000/T)+((1.2\times[\%\ C])+(0.5\times[\%\ Si])+(2\times[\%\ Mn])+(1.4\times[\%\ Cr]))\} \quad (3)$$

where T is a heating temperature [° C.], and [% M] is the content in mass % of the element M.

3. The method according to claim 2, wherein the holding time is A or longer and 2.0 A or less.

4. The rail according to claim 1, wherein the content of C is 0.70 mass % or more and 0.85 mass % or less.

5. The rail according to claim 1, wherein the content of C is 0.70 mass % or more and 0.84 mass % or less.

6. A rail comprising a chemical composition consisting of
C: 0.70 mass % or more and 1.00 mass % or less,
Si: 0.50 mass % or more and 1.60 mass % or less,
Mn: 0.20 mass % or more and 1.00 mass % or less,
P: 0.035 mass % or less,
S: 0.012 mass % or less,
Cr: 0.40 mass % or more and 1.30 mass % or less,
Sb: 0.001 mass % or more and 0.05 mass % or less, and
optionally, at least one selected from the group consisting of
V: 0.30 mass % or less,
Cu: 1.0 mass % or less,
Ni: 1.0 mass % or less,
Nb: 0.05 mass % or less,
Mo: 0.5 mass % or less,
Al: 0.07 mass % or less,
W: 1.0 mass % or less,
B: 0.005 mass % or less, and
Ti: less than 0.010 mass %,
where a Ceq value defined by the following formula (1) is in a range of 1.04 or more and 1.25 or less, $$Ceq=[\%\ C]+([\%\ Si]/11)+([\%\ Mn]/7)+([\%\ Cr]/5.8) \quad (1)$$

where [% M] is the content in mass % of the element M,
the balance being Fe and inevitable impurities, wherein
Vickers hardness of a region between a position where a depth from a surface of a rail head is 1 mm and a position where the depth is 25 mm is 370 HV or more and less than 520 HV; a Ceq(max) is 1.40 or less, where the Ceq(max) is determined by the following formula (2) using a maximum content of each component of C, Si, Mn, and Cr, which are obtained by subjecting the region to line analysis with EPMA, which stands for an Electron Probe Micro Analyzer; and a pearlite area ratio in the region is 95% or more, $$Ceq(max)=[\%\ C(max)]+([\%\ Si(max)]/11)+([\%\ Mn(max)]/7)+([\%\ Cr(max)]/5.8) \quad (2)$$

where [% M(max)] is the maximum content of the element M obtained by line analysis with EPMA.

7. A method of manufacturing a rail, comprising heating a steel material having the chemical composition according to claim 6 to a temperature range of higher than 1150° C. and 1350° C. or lower, holding the steel material in the temperature range for a holding time of A in seconds defined by the following formula (3) or longer, and then subjecting the steel material to hot rolling where a rolling finish temperature is 850° C. or higher and 950° C. or lower, and then to cooling where a cooling start temperature is equal to or higher than a pearlite transformation start temperature, a cooling stop temperature is 400° C. or higher and 600° C. or lower, and a cooling rate is 1° C./s or higher and 5° C./s or lower, $$A(s)=\exp\{(6000/T)+((1.2\times[\%\ C])+(0.5\times[\%\ Si])+(2\times[\%\ Mn])+(1.4\times[\%\ Cr]))\} \quad (3)$$

where T is a heating temperature [° C.], and [% M] is the content in mass % of the element M.

8. The method according to claim 7, wherein the holding time is A or longer and 2.0 A or less.

* * * * *